US009859055B2

(12) United States Patent
Miyamoto et al.

(10) Patent No.: US 9,859,055 B2
(45) Date of Patent: Jan. 2, 2018

(54) MANUFACTURING METHOD FOR RARE-EARTH MAGNET

(71) Applicants: Noritaka Miyamoto, Toyota (JP); Daisuke Ichigozaki, Nisshin (JP); Tetsuya Shoji, Toyota (JP); Eisuke Hoshina, Toyota (JP); Akira Kano, Toyota (JP); Osamu Yamashita, Toyota (JP)

(72) Inventors: Noritaka Miyamoto, Toyota (JP); Daisuke Ichigozaki, Nisshin (JP); Tetsuya Shoji, Toyota (JP); Eisuke Hoshina, Toyota (JP); Akira Kano, Toyota (JP); Osamu Yamashita, Toyota (JP)

(73) Assignee: TOYOTA JIDOSHA KABUSHIKI KAISHA, Aichi (JP)

( * ) Notice: Subject to any disclaimer, the term of this patent is extended or adjusted under 35 U.S.C. 154(b) by 448 days.

(21) Appl. No.: 14/435,228

(22) PCT Filed: Oct. 4, 2013

(86) PCT No.: PCT/JP2013/077043
§ 371 (c)(1),
(2) Date: Apr. 13, 2015

(87) PCT Pub. No.: WO2014/061466
PCT Pub. Date: Apr. 24, 2014

(65) Prior Publication Data

US 2015/0279559 A1 Oct. 1, 2015

(30) Foreign Application Priority Data

Oct. 18, 2012 (JP) ..... 2012-231013

(51) Int. Cl.
*C22C 33/02* (2006.01)
*B22F 3/02* (2006.01)
(Continued)

(52) U.S. Cl.
CPC ..... *H01F 41/0266* (2013.01); *B22F 3/02* (2013.01); *B22F 3/14* (2013.01); *B22F 3/17* (2013.01);
(Continued)

(58) Field of Classification Search
CPC ..... H01F 41/0266; H01F 41/0273; H01F 1/0576; H01F 1/08; B22F 3/02;
(Continued)

(56) References Cited

U.S. PATENT DOCUMENTS 4,792,367 A 12/1988 Lee
5,129,963 A 7/1992 Panchanathan et al.
(Continued)

FOREIGN PATENT DOCUMENTS

CN 1234589 A 11/1999
CN 1358595 A 7/2002
(Continued)

OTHER PUBLICATIONS

Communication dated May 26, 2016 from U.S. Patent & Trademark Office in counterpart U.S. Appl. No. 14/437,898.
(Continued)

*Primary Examiner* — Colleen Dunn
*Assistant Examiner* — Anthony Liang
(74) *Attorney, Agent, or Firm* — Sughrue Mion, PLLC

(57) ABSTRACT

Provided is a method for manufacturing a rare-earth magnet capable of manufacturing a rare-earth magnet with high degree of orientation by sufficient plastic deformation while suppressing cracks at the side faces of a compact that is plastic-deformed during the hot deformation processing. The method includes a step of preparing a compact S,
(Continued)

preparing a plastic processing mold including a die D in which a cavity Ca is provided, and punches P that are slidable in the cavity Ca, the cavity Ca having a cross section that is larger in cross-sectional dimensions than a cross section of the compact S that is orthogonal to a pressing direction by the punches P; and a step of placing the compact S in the cavity Ca and performing hot deformation processing, thus manufacturing an orientational magnet C. Let that W1 denotes a length of a short side of the cross section of the cavity Ca and t1 denotes a length of a side of the cross section of the compact S that is placed in the cavity Ca, the side corresponding to the short side of the cavity Ca, t1/W1 is within a range of 0.55 to 0.85, and from some stage during the hot deformation processing, a part of the compact S is constrained at a side face of the cavity Ca so that deformation of the compact is suppressed, but another part of the compact is in a non-constraint state.

5 Claims, 12 Drawing Sheets

(51) Int. Cl.

| | |
|---|---|
| ***H01F 41/02*** | (2006.01) |
| ***B22F 3/14*** | (2006.01) |
| ***C22C 38/00*** | (2006.01) |
| ***H01F 1/057*** | (2006.01) |
| ***B22F 3/17*** | (2006.01) |
| ***H01F 1/08*** | (2006.01) |
| *B22F 1/00* | (2006.01) |

(52) U.S. Cl.
CPC ..... *C22C 33/02* (2013.01); *C22C 38/00* (2013.01); *C22C 38/002* (2013.01); *C22C 38/005* (2013.01); *H01F 1/0576* (2013.01); *H01F 1/08* (2013.01); *H01F 41/0273* (2013.01); *B22F 1/0044* (2013.01); *B22F 2998/10* (2013.01); *B22F 2999/00* (2013.01); *C22C 2202/02* (2013.01)

(58) Field of Classification Search
CPC ..... B22F 3/14; B22F 3/17; B22F 2999/00; B22F 2998/10; C22C 33/02; C22C 38/002; C22C 38/005; C22C 2202/02
See application file for complete search history.

(56) References Cited

U.S. PATENT DOCUMENTS

| | | | |
|---|---|---|---|
| 5,641,363 | A | 6/1997 | Fukuno et al. |
| 6,319,335 | B1 | 11/2001 | Hirota et al. |
| 8,846,136 | B2 | 9/2014 | Shoji et al. |
| 9,257,227 | B2 | 2/2016 | Haga et al. |
| 2003/0136469 | A1 | 7/2003 | Makita et al. |
| 2005/0268989 | A1 | 12/2005 | Tomizawa et al. |
| 2005/0284545 | A1 | 12/2005 | Komuro et al. |
| 2006/0005898 | A1 | 1/2006 | Liu et al. |
| 2006/0022175 | A1 | 2/2006 | Komuro et al. |
| 2006/0054245 | A1 | 3/2006 | Liu et al. |
| 2006/0278517 | A1 | 12/2006 | Machida et al. |
| 2007/0240789 | A1 | 10/2007 | Nakamura et al. |
| 2008/0223489 | A1 | 9/2008 | Nagata et al. |
| 2009/0020193 | A1 | 1/2009 | Ohta et al. |
| 2010/0003156 | A1 | 1/2010 | Suzuki et al. |
| 2011/0000586 | A1 | 1/2011 | Nomura et al. |
| 2011/0036460 | A1 | 2/2011 | Nagata et al. |
| 2011/0090032 | A1 | 4/2011 | Nagata et al. |
| 2012/0114515 | A1 | 5/2012 | Kaneko et al. |
| 2012/0299675 | A1 | 11/2012 | Honkura et al. |
| 2012/0312422 | A1 | 12/2012 | Yano et al. |
| 2013/0009736 | A1 | 1/2013 | Honkura et al. |
| 2013/0078369 | A1 | 3/2013 | Shoji et al. |
| 2013/0195710 | A1 | 8/2013 | Haga et al. |
| 2014/0242267 | A1 | 8/2014 | Shoji et al. |
| 2014/0283649 | A1 | 9/2014 | Kunieda et al. |
| 2014/0308441 | A1 | 10/2014 | Shoji et al. |
| 2015/0228386 | A1 | 8/2015 | Sakuma et al. |
| 2015/0235747 | A1 | 8/2015 | Miyamoto et al. |
| 2015/0279529 | A1 | 10/2015 | Ichigozaki et al. |
| 2015/0279559 | A1 | 10/2015 | Miyamoto et al. |
| 2015/0287528 | A1 | 10/2015 | Haga et al. |
| 2016/0141083 | A1 | 5/2016 | Ito et al. |

FOREIGN PATENT DOCUMENTS

| | | | |
|---|---|---|---|
| CN | 101521068 | A | 9/2009 |
| CN | 101640087 | A | 2/2010 |
| CN | 103227019 | A | 7/2013 |
| EP | 1970924 | A1 | 9/2008 |
| JP | 02-003904 | A | 1/1990 |
| JP | 02047815 | A | 2/1990 |
| JP | 2-208902 | A | 8/1990 |
| JP | 02-238611 | A | 9/1990 |
| JP | 02-250918 | A | 10/1990 |
| JP | 02-250919 | A | 10/1990 |
| JP | 02-250920 | A | 10/1990 |
| JP | 02-250922 | A | 10/1990 |
| JP | 04-006811 | A | 1/1992 |
| JP | 04-044301 | A | 2/1992 |
| JP | 04-134804 | A | 5/1992 |
| JP | 5-182851 | A | 7/1993 |
| JP | 6231926 | A | 8/1994 |
| JP | 7-283016 | A | 10/1995 |
| JP | 8-250356 | A | 9/1996 |
| JP | 8-316014 | A | 11/1996 |
| JP | 9-275004 | A | 10/1997 |
| JP | 2693601 | B2 | 12/1997 |
| JP | 10-172850 | A | 6/1998 |
| JP | 10-284314 | A | 10/1998 |
| JP | 11-329810 | A | 11/1999 |
| JP | 3033127 | B2 | 4/2000 |
| JP | 2002-144328 | A | 5/2002 |
| JP | 2003-229306 | A | 8/2003 |
| JP | 2007-517414 | A | 6/2007 |
| JP | 2007-524986 | A | 8/2007 |
| JP | 2008-505500 | A | 2/2008 |
| JP | 2008-235343 | A | 10/2008 |
| JP | 2008-263179 | A | 10/2008 |
| JP | 2009-043813 | A | 2/2009 |
| JP | 2010-074084 | A | 4/2010 |
| JP | 2010-98115 | A | 4/2010 |
| JP | 2010-114200 | A | 5/2010 |
| JP | 4482769 | B2 | 6/2010 |
| JP | 2010-263172 | A | 11/2010 |
| JP | 2011-14668 | A | 1/2011 |
| JP | 2011-035001 | A | 2/2011 |
| JP | 2011-61038 | A | 3/2011 |
| JP | 4656323 | B2 | 3/2011 |
| JP | 2011-82467 | A | 4/2011 |
| JP | 2011-159733 | A | 8/2011 |
| JP | 4748163 | B2 | 8/2011 |
| JP | 2012-43968 | A | 3/2012 |
| JP | 2012-234985 | A | 11/2012 |
| JP | 2013-105903 | A | 5/2013 |
| JP | 5196080 | B2 | 5/2013 |
| JP | 2013-110387 | A | 6/2013 |
| JP | 2013-175705 | A | 9/2013 |
| KR | 10-2012-0135337 | A | 12/2012 |
| WO | 2004/072311 | A2 | 8/2004 |
| WO | 2004081954 | A1 | 9/2004 |
| WO | 2011/043158 | A1 | 4/2011 |
| WO | 2011-070827 | A1 | 6/2011 |
| WO | 2011/070847 | A1 | 6/2011 |
| WO | 2012/008623 | A1 | 1/2012 |
| WO | 2012/036294 | A1 | 3/2012 |

OTHER PUBLICATIONS

Communication dated Jul. 29, 2016 from U.S. Patent & Trademark Office in counterpart U.S. Appl. No. 14/437,898.

(56) References Cited

OTHER PUBLICATIONS

Mishima et al., "Development of a Dy-Free NdFeB Anisotropic Bonded Magnet with a High Thermal Stability", Proceedings of the 21st Workshop on Rare-Earth Permanent Magnets and their Applications, 2010, p. 253-256, REPM '10.
Makita et al., "Boundary Structure and the Local Crystalline Electric Field of Nd—Fe—B Sintered Magnets", Journal of Magnetics Society of Japan, Oct. 1, 2002, pp. 1060-1067, vol. 26, No. 10.
Hirosawa et al., "Recent Efforts Toward Rare-Metal-Free Permanent Magnets in Japan", Proceedings of the 21st Workshop on Rare-Earth Permanent Magnets and their Applications, 2010, pp. 187-191, REPM '10.
Tomoki Fukugawa, "Nd/NdFeB Artificial Interface Microstructure and the Intrinsic Coercivity of Surface Nd2Fe14B Grains", NEOMAX Company, Hitachi Metals Ltd., Mar. 2008, pp. 40-45, vol. 24.
Li et al., "The role of Cu addition in the coercivity enhancement of sintered Nd—Fe—B permanent magnets", J. Mater. Res., Feb. 2009, pp. 413-419, vol. 24, No. 2.
Wenjian Mo, et al., "Dependence of the crystal structure of the Nd-rich phase on oxygen content in an Nd—Fe—B sintered magnet", Scripta Materialia, pp. 179-182, vol. 59 (2008).
Machine Translation of JP 2005-209932.
Communication from United States Patent and Trademark Office dated Nov. 12, 2015 in U.S. Appl. No. 14/355,389.
Communication from United States Patent and Trademark Office dated Jul. 25, 2016 in U.S. Appl. No. 14/441,695.
Communication from United States Patent and Trademark Office dated Jul. 29, 2016 in U.S. Appl. No. 14/610,229.
Communication from United States Patent and Trademark Office dated Jul. 16, 2015 in U.S. Appl. No. 13/750,576.
Fukagawa et al., "The effect of oxygen on the surface coercivity of Nd-coated Nd—Fe—B sintered magnets", Journal of Applied Physics, 2009, vol. 105, 3 pages total.
Notice of Allowance from the United States Patent and Trademark Office dated Sep. 30, 2015 in U.S. Appl. No. 13/750,576.
Liu et al., Increased coercivity in sintered Nd—Fe—magnets with NdF3 additions and the related grain boundary phase, Scripta Materialia, 2009, vol. 61, pp. 1048-1051.
Komuro et al., "Structure and magnetic properties of NdFeB powder surrounded with layer of rare-earth fluorides", Journal of Applied Physics, 2008, vol. 103, 3 pages total.
International Search Report, issued by International Searching Authority in International Application No. PCT/JP2013/080691 dated Dec. 17, 2013.
Corrected Notice of Allowability from United States Patent and Trademark Office dated Jan. 6, 2016 in U.S. Appl. No. 13/750,576.
Machine Translation of JP06231926 A, Aug. 19, 1994.
International Search Report of PCT/JP2014/064995, dated Sep. 22, 2014 PCT/ISA/210.
Communication from United States Patent and Trademark Office dated Apr. 26, 2016 in U.S. Appl. No. 14/237,702.
Communication from United States Patent and Trademark Office dated Aug. 10, 2016 in U.S. Appl. No. 14/237,702.
Communication dated Mar. 2, 2017 from U.S. Patent & Trademark Office in counterpart U.S. Appl. No. 14/437,898.
International Search Report for PCT/JP2013/077043 dated Jan. 14, 2014 [PCT/ISA/210].

(a)

(b)

(a)

(b)

(c)

MANUFACTURING METHOD FOR RARE-EARTH MAGNET

CROSS REFERENCE TO RELATED APPLICATIONS

This application is a National Stage of International Application No. PCT/JP2013/077043 filed Oct. 4, 2013, claiming priority based on Japanese Patent Application No. 2012-231013 filed Oct. 18, 2012, the contents of all of which are incorporated herein by reference in their entirety.

TECHNICAL FIELD

The present invention relates to a method for manufacturing a rare-earth magnet in the form of an orientational magnet formed by hot deformation processing.

BACKGROUND ART

Rare-earth magnets containing rare-earth elements such as lanthanoide are called permanent magnets as well, and are used for motors making up a hard disk and a MRI as well as for driving motors for hybrid vehicles, electric vehicles and the like.

Indexes for magnet performance of such rare-earth magnets include remanence (residual flux density) and a coercive force. Meanwhile, as the amount of heat generated at a motor increases because of the trend to more compact motors and higher current density, rare-earth magnets included in the motors also are required to have improved heat resistance, and one of important research challenges in the relating technical field is how to keep magnetic characteristics of a magnet at high temperatures.

The following briefly describes one example of the method for manufacturing a rare-earth magnet. For instance, in a typically available method, Nd—Fe—B molten metal is solidified rapidly to be fine powder, while pressing-forming the fine powder to be a compact. Hot deformation processing is then performed to this compact to give magnetic anisotropy thereto to prepare a rare-earth magnet (orientational magnet).

The hot deformation processing is performed by placing a compact between upper and lower punches, for example, followed by pressing with the upper and lower punches for a short time such as about 1 second or less while heating, so that processing is performed with the ratio of processing of at least 50% or more. Such hot deformation processing can give magnetic anisotropy to the compact, but has a problem that, during the course of the compact being crushed while being plastic-deformed by the pressure from the upper and lower punches in the hot deformation processing, the plastic deformed compact tends to generate cracks (including micro-cracks) at the side faces.

This results from excessive deformation of a part of the compact that comes into contact with the upper and lower punches, and accordingly excessive swelling occurs at the central part at the side faces, i.e., the deformation shaped like a barrel as one reason. Such cracks cause the processing deformation that is formed to improve the degree of orientation to be open at the positions of the cracks, thus failing to direct the deformation energy to the crystalline orientation sufficiently. As a result, an orientational magnet obtained cannot have high degree of orientation (such high degree of orientation means high degree of magnetization).

Due to such cracks generated at the periphery, an orientational magnet that is shaped by hot deformation processing is cut out at a central part of predetermined dimensions that is free from cracks for a product, which means low material yield unfortunately.

Then as a conventional technique to solve such a problem of cracks generated during hot deformation processing, Patent Literature 1 discloses a manufacturing method. This manufacturing method is to enclose the compact as a whole into a metal capsule, followed by hot deformation processing while pressing this metal capsule with upper and lower punches. They say that this manufacturing method can improve magnetic anisotropy of the rare-earth magnet. Such a technique of performing hot deformation processing while enclosing a compact into a metal capsule is disclosed in Patent Literatures 2 to 5 as well.

When the compact as a whole is completely enclosed with a metal capsule, however, lateral plastic deformation of the compact due to pressure applied vertically is extremely constrained, and so no cracks are generated at the side faces of the compact after the plastic deformation, but this leads to another problem that it is difficult to achieve sufficient plastic deformation, resulting in the difficulty in obtaining high degree of orientation. For instance, in the case of a cylindrical-columnar compact having the upper face, the lower face and the circumferential side face, this is caused by, when the side-face area of the metal capsule corresponding to the side face of the compact is plastic-deformed laterally, the upper-face area and the lower-face area that are integrated with the side-face area, corresponding to the upper face and the lower face of the compact, constraining the stretching of the side-face area.

None of the aforementioned Patent Literatures mention the rate of strain, and assume that hot deformation processing is performed with the rate of strain of 0.1/sec or more and the ratio of processing of 50% or more (e.g., 70% or more), cracks cannot be prevented completely. This is because, when processing is performed with the rate of strain of 0.1/sec or more while covering the entire face with a steel material of a predetermined thickness or more by welding, impact receiving the magnet structure is too strong, or when the compact is cooled, the compact subjected to hot deformation processing is strongly constrained by the metal capsule as described above due to a difference in heat expansion. To solve this problem, Patent Literature 6 discloses the technique of making a metal capsule thinner by forging through multiple steps, and the embodiment disclosed uses an iron plate of 7 mm or more in thickness. This cannot prevent cracks completely, and additionally the shape of the magnet after forging cannot be said a near net shape, which requires finish processing at the entire face, thus worsening a problem, such as a decrease in material yield and an increase in processing cost.

When the thickness of a metal capsule covering the entire face of a compact completely is made thinner as disclosed in Patent Literature 1, for example, such a metal capsule will be damaged at the rate of strain of 1/sec or more, which causes discontinuous unevenness at the compact and so causes a disturbance of orientation. In this way, such a method cannot be said a preferable method.

CITATION LIST

Patent Literatures

Patent Literature 1: JP H02-250920 A
Patent Literature 2: JP H02-250922 A
Patent Literature 3: JP H02-250919 A
Patent Literature 4: JP H02-250918 A
Patent Literature 5: JP H04-044301 A
Patent Literature 6: JP H04-134804 A

SUMMARY OF INVENTION

Technical Problem

In view of the aforementioned problems, the present invention relates to a method for manufacturing a rare-earth magnet through hot deformation processing, and aims to provide a method for manufacturing a rare-earth magnet capable of manufacturing a rare-earth magnet with high degree of orientation by sufficient plastic deformation while suppressing cracks at the side faces of a compact that is plastic-deformed during the hot deformation processing.

Solution to Problem

In order to fulfill the object, a method for manufacturing a rare-earth magnet of the present invention, includes: a first step of press-forming powder as a rare-earth magnetic material to form a columnar compact; preparing a plastic processing mold including a die in which a cavity is provided to place the compact therein, and punches that are slidable in the cavity, the cavity having a cross section that is larger in cross-sectional dimensions than a cross section of the compact that is orthogonal to a pressing direction by the punches; and a second step of placing the compact in the cavity and sandwiching the compact with the punches vertically, and performing hot deformation processing to give magnetic anisotropy to the compact while directly pressing an upper face and a lower face of the compact with the punches vertically, thus manufacturing the rare-earth magnet that is an orientational magnet. Let that W1 denotes a length of a short side of the cross section of the cavity and t1 denotes a length of a side of the cross section of the compact that is placed in the cavity, the side corresponding to the short side of the cavity, t1/W1 is within a range of 0.55 to 0.85, and from some stage during the hot deformation processing at the second step, a part of the compact is constrained at a side face of the cavity so that deformation of the compact is suppressed, but another part of the compact is away from a side face of the cavity to be in a non-constraint state.

The method for manufacturing a rare-earth magnet of the present invention is to place a compact in a plastic processing mold for hot deformation processing, and in this method, a part of the compact only is firstly allowed to come into contact with a side face of a cavity of the plastic processing mold to receive pressure therefrom for crushing, instead of a processing method of bringing the entire side face of the compact into contact with the entire side face of the cavity. At this time, another part of the compact does not come into contact with the side face of the cavity to be in a non-constraint state, whereby hot deformation processing is performed to the compact desirably while giving magnetic anisotropy thereto so as not to generate cracks at the orientational magnet obtained.

When a part of the compact only is firstly allowed to come into contact with a side face of a cavity, the cross-sectional shape of the compact and the cross-sectional shape of a die making up the plastic processing mold have to be defined. The "cross-sectional shape" mentioned herein means a shape in cross section that is orthogonal to the sliding direction (the direction in which the compact is pressed by punches) of the punches. Examples of the cross-sectional shape of the cavity in the manufacturing method of the present invention include, but not limited thereto, a rectangle, a horizontally-long ellipse and the like, and examples of the cross-sectional shape of the compact having cross-sectional dimensions smaller than the cavity before hot deformation processing include a square, a rectangle, a circle and the like. That is, in one embodiment, a compact having a rectangular, a square, or a circular cross section is placed in a cavity having a rectangular cross section for hot deformation processing, and in another embodiment, a compact having a rectangular, a square, or a circular cross section is placed in a cavity having an elliptical cross section for hot deformation processing. Then, the cavity and the compact have a relationship in cross-sectional dimension such that, when such a compact is placed in the cavity, the side face of the compact does not come into contact with the side face of the cavity at any part, and as the compact is crushed and deformed with the progress of the hot deformation processing, a part of the compact comes into contact with the side face of the cavity to receive pressure therefrom.

According to the manufacturing method of the present invention, at the first step, powder as a rare-earth magnetic material is press-formed to form a columnar compact.

Rare-earth magnets as a target of the manufacturing method of the present invention include not only nanocrystalline magnets including a main phase (crystals) making up the structure of about 200 nm or less in grain size but also those of about 300 nm or more in grain size as well as sintered magnets and bond magnets including crystalline grains bound with resin binder of 1 μm or more in grain size. Among them, it is desirable that the dimensions of the main phase of magnet powder before the hot deformation processing are adjusted so that the rare-earth magnet finally manufactured has the main phase having the average maximum dimension (average maximum grain size) of about 300 to 400 nm or less.

A melt-spun ribbon (rapidly quenched ribbon) as fine crystalline grains is prepared by rapid-quenching of liquid, and the melt-spun ribbon is coarse-ground, for example, to prepare magnetic powder for rare-earth magnet. This magnetic powder is loaded into a die, for example, and is sintered while applying pressure thereto with punches to be a bulk, thus forming an isotropy compact.

This compact has a metal structure including a RE-Fe—B main phase of a nano-crystal structure (RE: at least one type of Nd and Pr, and specifically any one type or two types or more of Nd, Pr, Nd—Pr) and a RE-X alloy (X: metal element) grain boundary phase surrounding the main phase.

At the second step, hot deformation processing is performed to the compact prepared at the first step to give anisotropy thereto, thus manufacturing a rare-earth magnet that is an orientational magnet.

Herein let that W1 denotes a length of a short side of the cross section of the cavity and t1 denotes a length of a side of the cross section of the compact that is placed in the cavity, the side corresponding to the short side of the cavity, t1/W1 is within a range of 0.55 to 0.85, and from some stage during the hot deformation processing at the second step, a part of the compact is constrained at the cavity so that deformation of the compact is suppressed. Herein, the "length of a side . . . corresponding to the short side of the cavity" refers to a side of the compact facing a short side of the cavity or when the compact is a circle in cross section, this refers to a half of the arc facing the cavity.

When the cavity is a rectangle in cross section, W1 denotes the length of the short sides thereof, and when the cavity is an ellipse in cross section, W1 denotes the length of the minor axis thereof. Meanwhile, when the compact prepared at the first step is a rectangle in cross section, such a compact is placed in the cavity so that the short sides thereof are "sides . . . corresponding to the short sides of the cavity", where t1 denotes the length of the short sides. When it is a square in cross section, since all sides have the same length, t1 denotes the length of any one side facing the short sides of the cavity.

Then, when such a compact receives pressure and is crushed gradually during the hot deformation processing, the long sides orthogonal to the short sides of the compact having a rectangular cross section, for example, come into contact with the side face of the cavity, and then the compact is further crushed and receives pressure. Then, when the hot deformation processing is finished, the short sides that are "the sides . . . corresponding to the side faces of the cavity" do not come into contact with the side faces of the cavity, and keeps a non-constraint state, i.e., the free state that does not receive pressure.

In this way, a part of the compact only is allowed to come into contact with the cavity to receive pressure therefrom, and magnetic anisotropy is given to such an area receiving pressure and the degree of orientation is improved there. On the other hand, magnetic anisotropy is not given to an area that does not receive pressure (short sides and the vicinity thereof). Herein, it is important so as not to generate cracks (micro-cracks) at the orientational magnet, including such an area to which magnetic anisotropy is not given, and an orientational magnet is manufactured so as to give magnetic anisotropy to a part of the magnet and so as not to generate cracks at the entire magnet, whereby the orientational magnet manufactured can have high remanence. When the magnet is used for a product, it is preferable to remove the area where magnetic anisotropy is not given.

The demonstration by the present inventors shows that, when t1/W1 is within the range of 0.55 to 0.85 and a part of the compact during the hot deformation processing is in a free state without being constrained, no cracks occur at the magnet, and the orientational magnet obtained can have high degree of magnetization. The present inventors further found that, in the specified range of t1/W1 of 0.55 to 0.85, the range of 0.6 to 0.8 is preferable because the degree of magnetization achieved becomes still higher.

If t1/W1 is larger than 0.85 for the case where both of the cavity and the compact are a rectangle in their cross section, for example, the compact will be deformed immediately after the starting of hot deformation processing, so that both of the long sides and the short sides come into contact with the cavity and receive a constraint force therefrom, and so the degree of freedom for deformation of the main phase (crystals) is impaired. This causes plastic flow occurring at the flow of crystals along the strain in the shearing direction, which degrades the degree of orientation of the crystals greatly. On the other hand, if t1/W1 is smaller than 0.55, the crystals of the compact will be deformed without receiving back pressure until the end of the hot deformation processing, meaning that it is difficult to achieve a desired degree of orientation at a part other than the center part of the compact in the width direction (short-side direction). Especially at the periphery, the flow of the crystals swirls, and so they are hardly oriented in the through-thickness direction. Meanwhile, the reason for generating no cracks resides in that, when the compact is a nano-crystalline magnet, for example, it has a grain boundary phase appropriately because of the component adjusted, and additionally orientation due to recrystallization and crystalline rotation at the grain boundary phase easily occur because the main phase is free from embrittlement resulting from oxidation and the like.

A modifier alloy such as a Nd—Cu alloy, a Nd—Al alloy, a Pr—Cu alloy, or a Pr—Al alloy may be grain-boundary diffused to the orientational magnet manufactured at the second step, to further improve the coercive force of the rare-earth magnet. A Nd—Cu alloy has a eutectic point of about 520° C., a Pr—Cu alloy has a eutectic point of about 480° C., a Nd—Al alloy has a eutectic point of about 640° C. and a Pr—Al alloy has a eutectic point of about 650° C., all of which is greatly below 700 to 1,000° C. that causes coarsening of crystalline grains making up a nano-crystalline magnet, and so they are especially preferable when the rare-earth magnet includes nano-crystalline magnet.

The hot deformation processing may include two steps successively performed using two plastic processing molds including cavities having different cross-sectional dimensions, for example, instead of only one processing performed for a short time. For instance, in an embodiment of the method of performing the two steps, two plastic processing molds are prepared, including two dies including cavities having different cross-sectional dimensions and punches having cross sections corresponding to the cross-sectional dimensions of the dies at the second step. Then hot deformation processing is performed to a compact using the plastic processing mold including a cavity having relatively smaller cross-sectional dimensions so as to bring a pair of opposed sides of the rectangular or square cross section of the compact into contact with the two opposed long sides of the cavity to prepare an intermediary body of the orientational magnet. Next, the intermediary body is placed in the plastic processing mold including a cavity having relatively larger cross-sectional dimensions, and hot deformation processing is performed thereto so as to bring a pair of opposed sides of the rectangular or square cross section of the intermediary body into contact with the two opposed long sides of the cavity to manufacture the rare-earth magnet in the form of an orientational magnet Let that the plastic processing mold including a cavity having relatively smaller cross-sectional dimensions is a first plastic processing mold, and the other is a second plastic processing mold, shapes of the compact and the cavity of the first plastic processing mold may be set so that a part of the compact comes into contact with the side faces of the cavity of the first plastic processing mold to receive pressure therefrom during the first hot deformation processing, and the short sides of them have a dimensional relationship of t1/W1 ranging from 0.55 to 0.85. Then the intermediary body of the orientational magnet having a desired shape whose cross sectional shape is increased in size during this hot deformation processing is transferred and placed in the second processing mold. At this time, shapes of the intermediary body and the cavity of the second plastic processing mold may be set so that a part of the intermediary body deformed comes into contact with the side faces of the cavity to receive pressure therefrom during the second hot deformation processing, and the short sides of them still have a dimensional relationship of t1/W1 ranging from 0.55 to 0.85. Note here that both of the first plastic processing mold and the second plastic processing mold do not have to satisfy the range of t1/W1 from 0.55 to 0.85, and when at least one of them satisfies this range, a certain effect can be obtained.

During the hot deformation processing, a rate of strain is preferably 0.1/sec. or more. This in combination with the range of t1/W1 that that is 0.55 to 0.85 can manufacture an orientational magnet having high degree of magnetization without generating cracks reliably.

Preferably, the powder as the rare-earth magnetic material includes a RE-Fe—B main phase (RE: at least one type of Nd and Pr) and a RE-X alloy (X: metal element) grain boundary phase surrounding the main phase, the powder being prepared by grinding a melt-spun ribbon, the content of RE being 29 mass %≤RE≤32 mass %, and the main phase of the rare-earth magnet manufactured having an average grain size of 300 nm or less.

To achieve the main phase of the rare-earth magnet having such an average grain size of 300 nm or less, the original magnetic powder may be adjusted to have an average grain size of about 200 nm.

Herein the "average grain size of the main phase" can be called an average crystalline grain size, which is found by detecting a large number of main phases in a certain area with a TEM image, a SEM image or the like of the magnetic powder and the rare-earth magnet, measuring the maximum length (long axis) of the main phase on a computer and then finding the average of the long axes of the main phases. The main phase of magnetic powder typically has a shape having a large number of corners that is relatively close to a circle in cross section, and the main phase of an orientational magnet subjected to hot deformation processing typically has a shape that is a relatively flattened and horizontally-long ellipse having corners. That is, for the long axis of the main phase of magnetic powder, the longest axis in the polygon is selected on the computer, and for the main phase of the orientational magnet, its long axis is easily specified on the computer, which are then used for calculation of the average grain size.

If RE is less than 29 mass %, cracks tend to occur during hot deformation processing, meaning extremely poor orientation, and if RE exceeds 29 mass %, strains from the hot deformation processing will be absorbed at a grain boundary that is soft, meaning poor orientation and a small ratio of the main phase, that is, leading to a decrease in residual flux density. That is why the content of RE is specified as 29 mass %≤RE≤32 mass %.

Advantageous Effects of Invention

As can be understood from the above descriptions, according to the method for manufacturing a rare-earth magnet of the present invention, when a compact is placed in a plastic processing mold for hot deformation processing, a part of the compact only is firstly allowed to come into contact with a side face of a cavity of the plastic processing mold to receive pressure therefrom, and at this time another part of the compact does not come into contact with the side face of the cavity to be in a non-constraint state, whereby hot deformation processing is performed to the compact desirably while giving magnetic anisotropy thereto so as not to generate cracks at the orientational magnet obtained. This means that the rare-earth magnet manufactured can have high degree of orientation and excellent magnetic characteristics including magnetization.

DESCRIPTION OF EMBODIMENTS

The following describes embodiments of a method for manufacturing a rare-earth magnet of the present invention, with reference to the drawings. The following illustrates an orientational magnet including nano-crystalline magnet (300 nm or less in grain size), and an orientational magnet as a target of the manufacturing method of the present invention is not limited to a nano-crystalline magnet, which includes a magnet of 300 nm or more in grain size, a sintered magnet and a bond magnet including crystalline grains bound with resin binder of 1 μm or more in grain size and the like.

Figure 1:
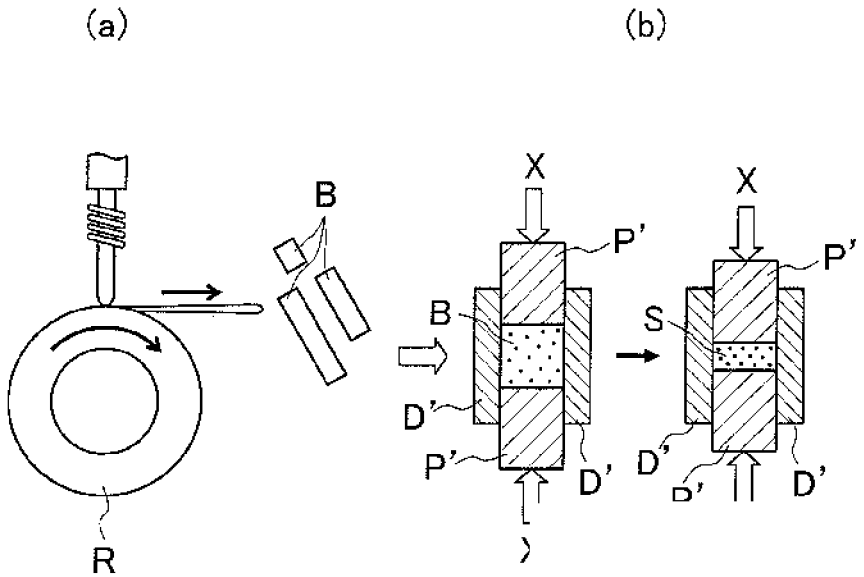
FIGS. 1*a, b* schematically illustrate a first step of a method for manufacturing a rare-earth magnet that is Embodiment 1 of the present invention in this order.
Figure 2:
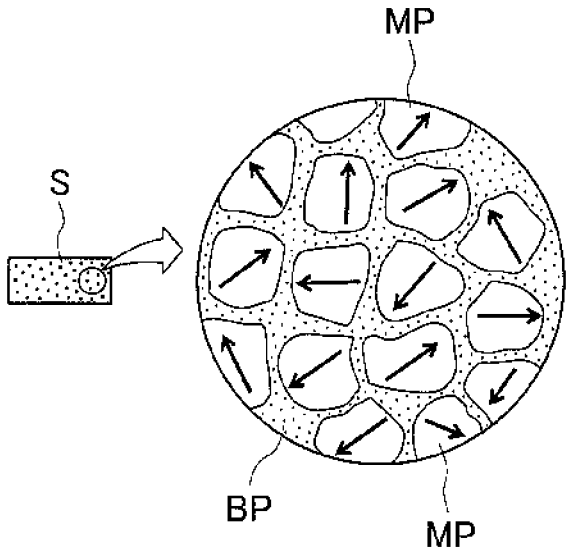
FIG. 2 illustrates the micro-structure of a compact that is manufactured by the first step.
Figure 3:
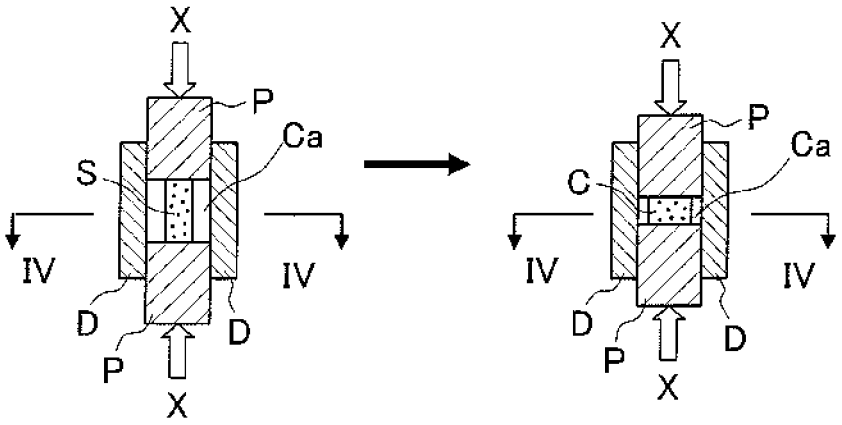
FIG. 3 schematically illustrates a second step of Embodiment 1 of the manufacturing method.
Figure 4:
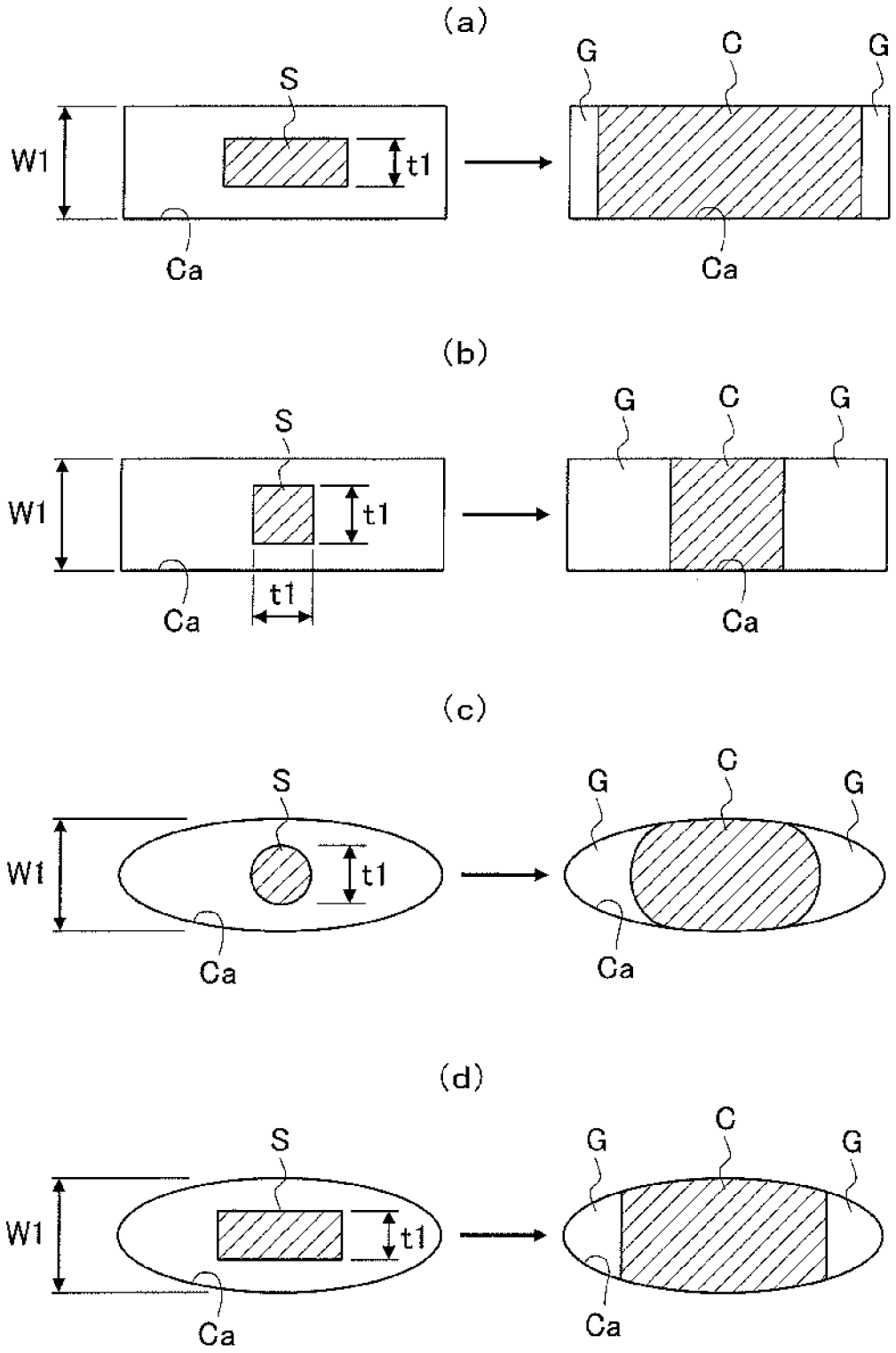
FIGS. 4*a* to *d* are views taken along the arrows IV to IV of FIG. 3, illustrating a cavity, a compact and an orientational magnet before and after hot deformation processing in their cross sections in embodiments.

Embodiment 1 of Manufacturing Method of a Rare-Earth Magnet and Such a Rare-Earth Magnet FIGS. 1*a, b* schematically illustrate a first step of a method for manufacturing a rare-earth magnet of the present invention in this order, and FIG. 2 illustrates the micro-structure of a compact that is manufactured by the first step. FIG. 3 schematically illustrates a second step of Embodiment 1 of the manufacturing method of the present invention.

As illustrated in FIG. 1*a*, alloy ingot is molten at a high frequency, and a molten composition giving a rare-earth magnet is injected to a copper roll R to manufacture a melt-spun ribbon B (rapidly quenched ribbon) by a melt-spun method using a single roll in an oven (not illustrated)

under an Ar gas atmosphere at reduced pressure of 50 kPa or lower, for example. The melt-spun ribbon obtained is then coarse-ground.

Among the melt-spun ribbons that are coarse-ground, a melt-spun ribbon B having a maximum grain size of about 200 nm or less is selected, and this is loaded in a cavity defined by a carbide die D' and a carbide punch P' sliding along the hollow of the carbide die as illustrated in FIG. 1*b*. Then, ormic-heating is performed thereto while applying pressure with the carbide punch P' (X direction) and letting current flow through in the pressuring direction, whereby a quadrangular-columnar compact S is manufactured, including a Nd—Fe—B main phase (having the grain size of about 50 nm to 200 nm) of a nano-crystalline structure and a Nd—X alloy (X: metal element) grain boundary phase around the main phase (first step). The content of RE is desirably 29 mass %≤RE≤32 mass %.

Herein, the Nd—X alloy making up the grain boundary phase is an alloy containing Nd and at least one type of Co, Fe, Ga and the like, which may be any one type of Nd—Co, Nd—Fe, Nd—Ga, Nd—Co—Fe, Nd—Co—Fe—Ga, or the mixture of two types or more of them, and is in a Nd-rich state.

As illustrated in FIG. 2, the compact S shows an isotropic crystalline structure where the space between the nano-crystalline grains MP (main phase) is filled with the grain boundary phase BP.

After preparing the quadrangular-columnar compact S at the first step, as illustrated in FIG. 3, the compact is placed in the cavity Ca defined by a carbide die D and a carbide punch P sliding along the hollow of the carbide die making up a plastic processing mold, and the upper and lower punches P, P are slid at the upper and lower faces of the compact S while bringing the upper and lower punches P, P closer to each other for a short time of 1 sec. or less (pressing in the X direction of FIG. 3) for hot deformation processing. As a result of this hot deformation processing, an orientational magnet C (rare-earth magnet) is manufactured (second step).

Herein the rate of strain is adjusted at 0.1/sec. or more during this hot deformation processing. When the degree of processing (ratio of compression) by the hot deformation processing is large, e.g., when the ratio of compression is about 10% or more, such hot deformation processing can be called heavily deformation processing.

Note here that the cavity Ca of the die D and the compact S may have cross-sectional shapes and dimensions as in embodiments illustrated in FIGS. 4*a* to *d*.

In the embodiment illustrated in FIG. 4*a*, a compact S that is a rectangle in cross section having a short side of the length t1 is placed in a cavity Ca that is a rectangle in cross section having a short side of the length W1, where t1/W1 is set in the range of 0.55 to 0.85. That is, when both of the cavity Ca and the compact S are a rectangle in cross section, the compact S is placed at around the center of the cavity Ca so that their short sides face each other.

As illustrated in FIG. 4*a* on the left side, the compact S is placed so as not be in contact with the side faces of the cavity Ca, and in this state, hot deformation processing is executed until the long sides of the orientational magnet C manufactured come in contact with the long sides of the cavity Ca as illustrated in FIG. 4*a* on the right side and the side faces of the orientational magnet C are in a non-constraint state having a gap G with the side faces of the cavity Ca.

According to the demonstration by the present inventors as described below, it is known that, when the ratio t1/W1 of the length t1 of the short side of a compact S and the length W1 of the short side of a cavity Ca is set in the range of 0.55 to 0.85, and specifically the ratio of the length of the long side of the compact S and the length of the long side of the cavity Ca is less than 0.55, after deformation of the compact S by hot deformation processing, the compact S and the side faces of the cavity Ca come into contact with each other at their long sides so that the compact S is pressed by the side faces of the cavity Ca, and the side faces of the compact S do not come into contact with the side faces of the cavity Ca and can be kept in a non-constraint state.

Then such a state of the compact S where a part thereof is pressed and another part thereof is in a not-constraint state during the hot deformation processing enables the manufacturing of an orientational magnet with excellent magnetization characteristics without generating cracks (including micro-cracks) in the orientational magnet C manufactured.

Figure 5:
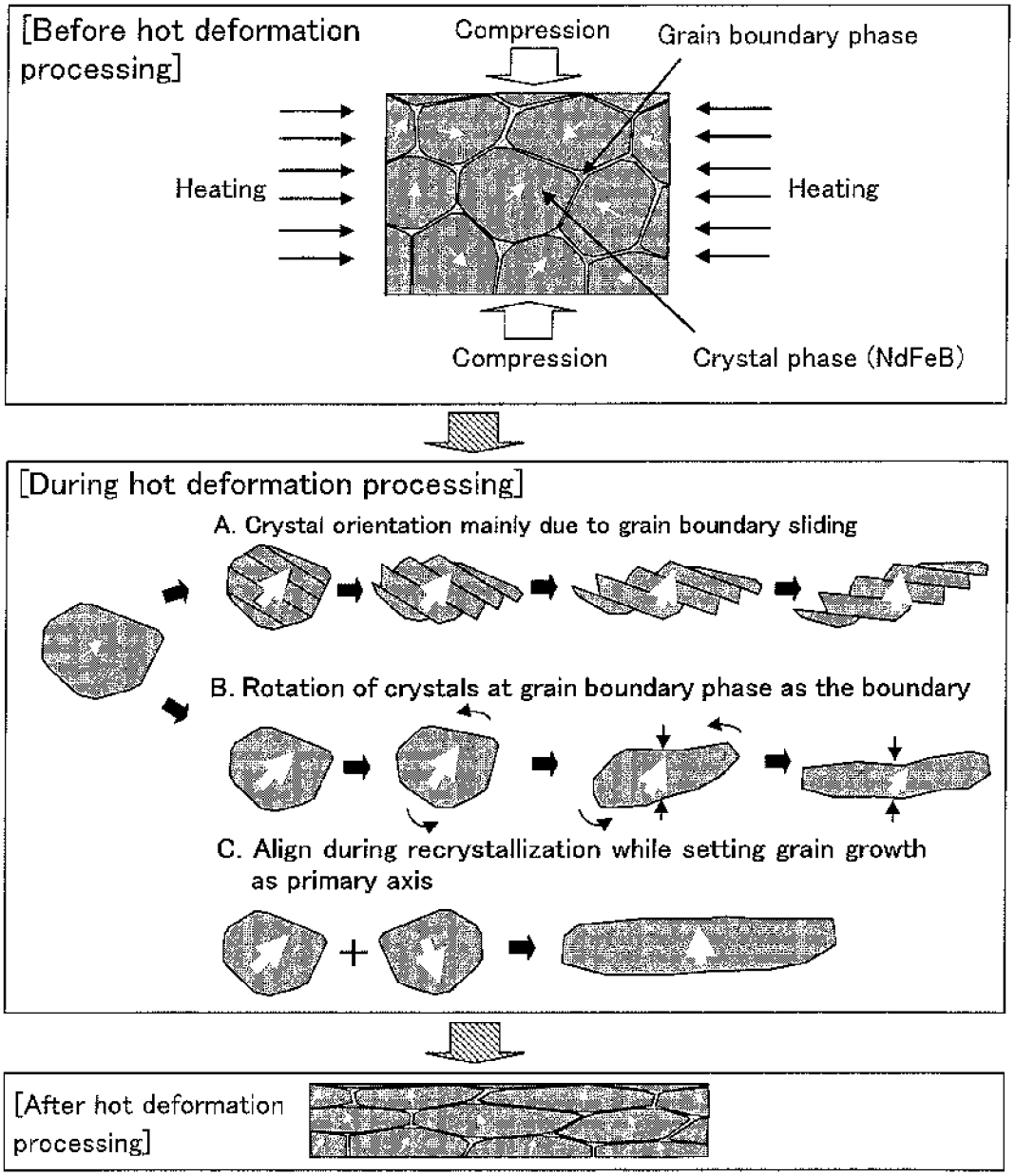
FIG. 5 schematically illustrates the micro-structure of a compact before hot deformation processing, the orientation mechanism of the main phase during the processing, and the micro-structure of the orientational magnet after the processing.

If t1/W1 is larger than 0.85, the compact will be deformed immediately after the starting of hot deformation processing, so that both of the long sides and the short sides come into contact with the cavity and receive a constraint force therefrom, and so the degree of freedom for deformation of the main phase (crystals) is impaired. This causes plastic flow occurring at the flow of crystals along the strain in the shearing direction, which degrades the degree of orientation of the crystals greatly. On the other hand, if t1/W1 is smaller than 0.55, the crystals of the compact will be deformed without receiving back pressure until the end of the hot deformation processing, meaning that it is difficult to achieve a desired degree of orientation at a part other than the center part of the compact in the width direction (short-side direction). Especially at the periphery, the flow of the crystals swirls, and so they are hardly oriented in the through-thickness direction. Meanwhile, the reason for generating no cracks resides in that, when the compact is a nano-crystalline magnet, for example, it has a grain boundary phase appropriately because of the component adjusted, and additionally as illustrated in the drawing to describe the crystalline orientation and the crystalline rotation during hot deformation processing at the middle of FIG. 5, orientation due to recrystallization and crystalline rotation at the grain boundary phase easily occur because the main phase is free from embrittlement resulting from oxidation and the like.

Referring back to FIG. 4, FIG. 4*b* illustrates the embodiment where a compact S that is a square in cross section having one side of the length t1 is placed in a cavity Ca that is a rectangle in cross section having a short side of the length W1, where t1/W1 is set in the range of 0.55 to 0.85. That is, when the cavity Ca is a rectangle and the compact S is a square in cross section, the compact S is placed at around the center of the cavity Ca so that any one of the sides of the compact S faces the short sides of the cavity Ca.

FIG. 4*c* illustrates the embodiment where a compact S that is a circle in cross section having a diameter of t1 is placed in a cavity Ca that is an ellipse in cross section having a miner axis of the length W1, where t1/W1 is set in the range of 0.55 to 0.85. That is, when the cavity Ca is an ellipse and the compact S is a circle in cross section, the compact S is placed at around the center of the cavity Ca.

FIG. 4*d* illustrates the embodiment where a compact S that is a rectangle in cross section having a short side of the length t1 is placed in a cavity Ca that is an ellipse in cross section having a miner axis of the length W1, where t1/W1 is set in the range of 0.55 to 0.85. That is, when the cavity Ca is an ellipse and the compact S is a rectangle in cross section, the compact S is placed at around the center of the cavity Ca so that the major axis of the cavity and the long sides of the compact S are in parallel.

In any embodiment of them for the plastic processing mold having a cavity Ca and the compact S, a part of the orientational magnet manufactured after hot deformation processing keeps a non-constraint state having a gap G from the side faces of the cavity Ca, which can suppress cracks, and the orientational magnet C manufactured can have excellent magnetic characteristics.

Figure 6:
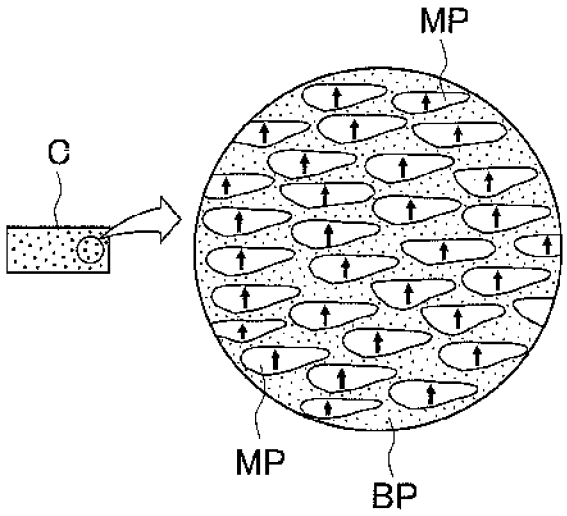
FIG. 6 describes the micro-structure of an orientational magnet (rare-earth magnet) manufactured of the present invention.

The orientational magnet C manufactured by hot deformation processing includes flattened-shaped nano-crystalline grains MP as illustrated in FIG. 6, whose boundary faces that are substantially in parallel to the anisotropic axis are curved or bent, meaning that the orientational magnet C has excellent magnetic anisotropy.

The orientational magnet C in the drawing is excellent because it has a metal structure including a RE-Fe—B main phase (RE: at least one type of Nd and Pr) and a RE-X alloy (X: metal element) grain boundary phase surrounding the main phase, the content of RE is 29 mass %≤RE≤32 mass %, and the main phase of the rare-earth magnet manufactured has an average grain size of 300 nm. Since the content of RE is within the range, the effect of suppressing cracks during hot deformation processing becomes higher, and higher degree of orientation can be guaranteed. Such a range of the content of RE further can ensure the size of the main phase achieving high residual flux density.

Figure 7:
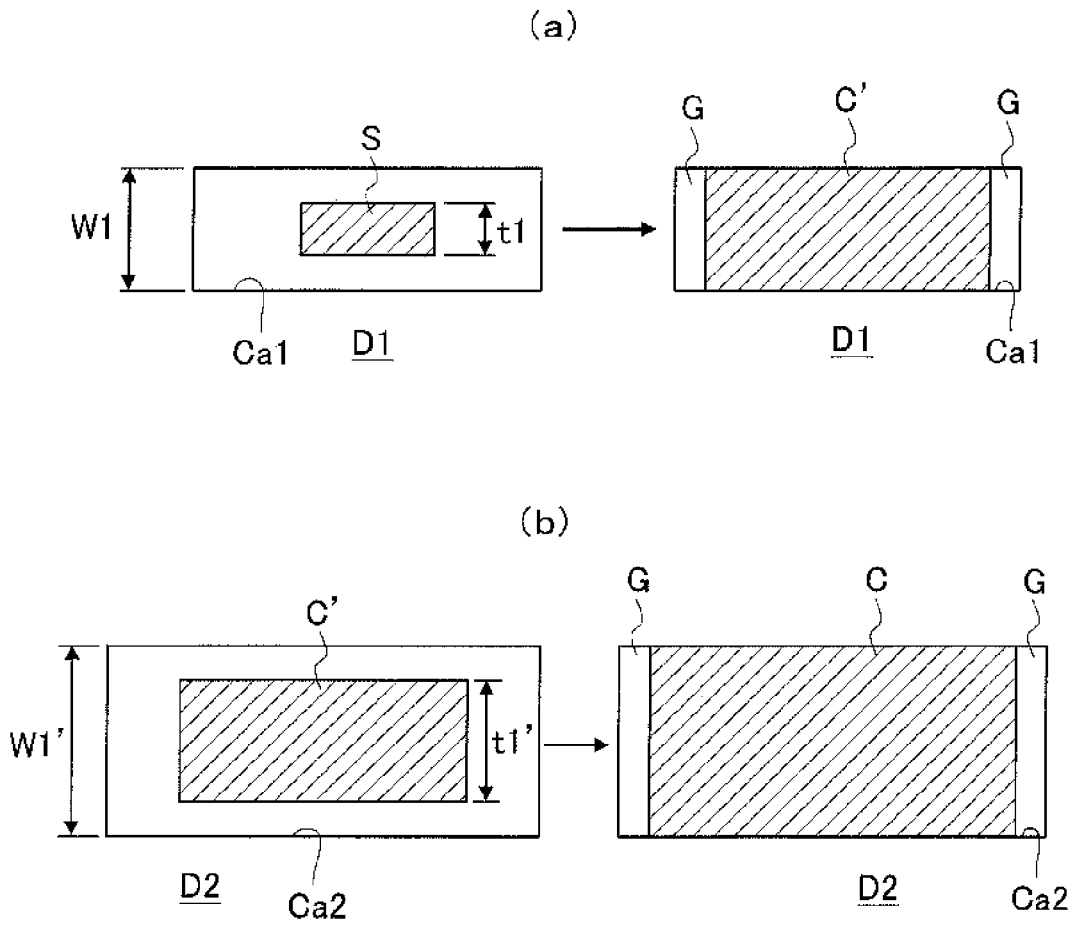
FIG. 7 schematically describes a method for manufacturing a rare-earth magnet that is Embodiment 2 of the present invention, where FIG. 7*a* describes a state where a compact is placed in a cavity of a first plastic processing mold, and a state of the cavity and an intermediary body of the orientational magnet after the hot deformation processing, and FIG. 7*b* describes a state where the intermediary body is placed in a cavity of a second plastic processing mold, and a state of the cavity and the orientational magnet after the hot deformation processing

Embodiment 2 of Manufacturing Method of a Rare-Earth Magnet and Such a Rare-Earth Magnet FIG. 7 schematically illustrates a manufacturing method of a rare-earth magnet that is Embodiment 2, where FIG. 7*a* illustrates from the state where a compact is placed in a cavity of a first plastic processing mold to the state of an intermediary body of the orientational magnet as well as the cavity after hot deformation processing, and FIG. 7*b* illustrates the state where the intermediary body is placed in a cavity of a second plastic processing mold to the state of the orientational magnet as well as the cavity after hot deformation processing. For easy understanding, FIGS. 7*a* and *b* illustrate cross sections of cavities Ca1 and Ca2 of dies D1 and D2 making up the two plastic processing molds and the compact S, the intermediary body C' of the orientational magnet and the orientational magnet C only.

The illustrated manufacturing method that is Embodiment 2 is to perform hot deformation processing through two stages using the two plastic processing molds (the first and second plastic processing molds). In the first step, two plastic processing molds are prepared, including the two dies D1 and D2 having cavities that are different in cross-sectional dimensions and punches not illustrated having cross sections in accordance with the cross-sectional dimensions of the dies D1 and D2.

At the second step, hot deformation processing is performed to a compact S using the first plastic processing mold including the die D1 whose cavity Ca1 has relatively small dimensions in cross section, where the compact S is placed in the cavity Ca1 of the die D1 so that the short sides and the long sides of the compact S that is a rectangle in cross section face the corresponding short sides and long sides of the cavity Ca1 (FIG. 7*a* on the left side). Then hot deformation processing is performed so as to bring the long sides of both into contact with each other to press the long sides of the compact S, thus manufacturing the intermediary body C' of the orientational magnet (FIG. 7*a* on the right side). At this stage, there is a gap G between the short sides of the intermediary body C' and the cavity Ca1.

Next, the intermediary body C' is placed in the second plastic processing mold including the die D2 whose cavity Ca2 has relatively large dimensions in cross section (FIG. 7*b* on the left side), and hot deformation processing is performed so as to bring the long sides of the second plastic processing mold into contact with the long sides of the intermediary body C' deformed to press the long sides of the intermediary body C', thus manufacturing the orientational magnet C (FIG. 7*b* on the right side). At this stage as well, there is a gap G between the short sides of the orientational magnet C and the cavity Ca2.

In the illustrated manufacturing method that is Embodiment 2 as well, a part of the compact S and the intermediary body C' is pressed and another part thereof is in a not-constraint state during the hot deformation processing, which enables the manufacturing of an orientational magnet with excellent magnetization characteristics without generating cracks (including micro-cracks) in the orientational magnet C manufactured.

[Experiment to Specify the Optimum Range of Ratio T1/W1 of the Length T1 of Short Side of Compact and the Length W1 of Short Side of Cavity Ca and Result Thereof]

Figure 8:
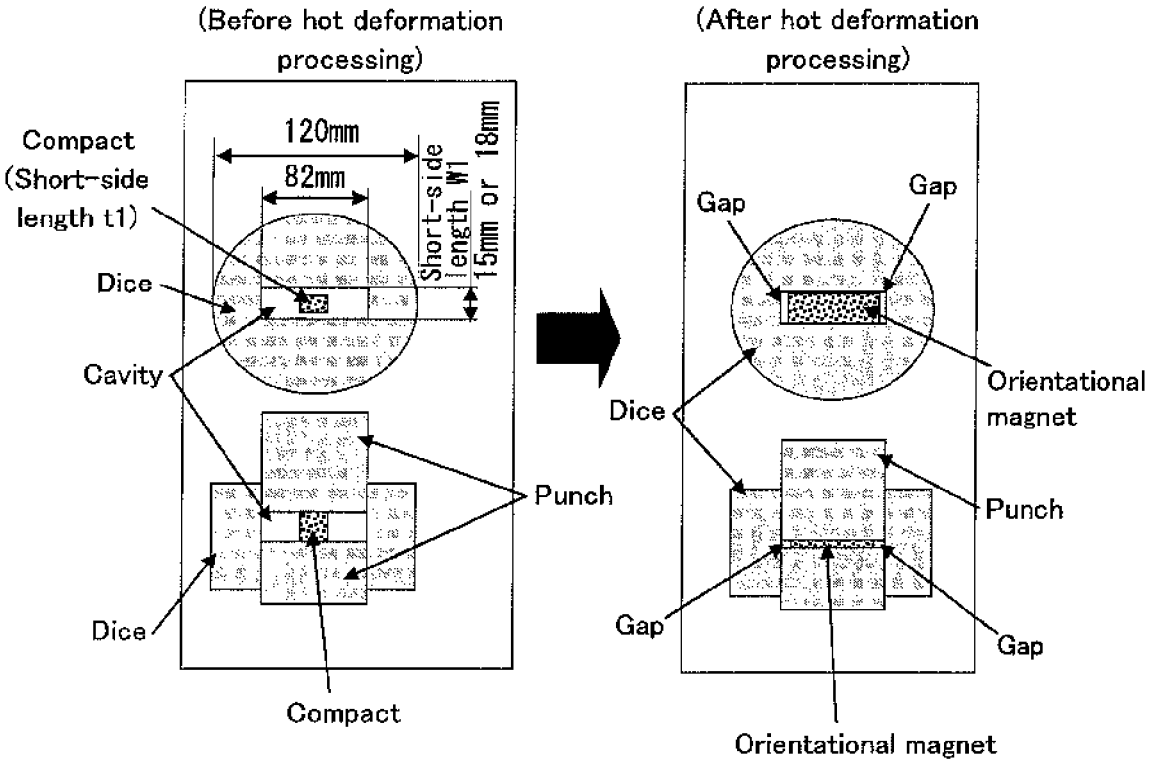
FIG. 8 illustrates dimensions of a cavity of a die and dimensions of a compact that were used for the experiments, showing the states before and after the hot deformation processing.

The present inventors conducted an experiment, in which a quadrangular-columnar compact S that is a rectangle in cross section was placed in a cavity of a die that is a rectangle in cross section and has the dimensions illustrated in FIG. 8 for hot deformation processing, and the remanence of the orientational magnet (test piece) manufactured was measured. In this experiment, the length t1 of the short sides of the compact and the length W1 of the short sides of the cavity were changed variously to manufacture a plurality of orientational magnets, and their remanence was measured. Then the relationship between t1/W1 and remanence of these orientational magnets was specified.

(Method for Manufacturing Orientational Magnets)

A predetermined amount of magnetic powder raw materials for rare-earth magnet (the alloy composition was Fe-30Nd-0.93B-4Co-0.4Ga in mass %) were mixed, which was then molten in an Ar atmosphere, followed by injection of the molten liquid thereof from an orifice of φ0.8 mm to a revolving roll made of Cu with Cr plating applied thereto for quenching, thus preparing alloy thin pieces. These alloy thin pieces were pulverized and screened with a cutter mill in an Ar atmosphere, whereby magnetic powder for rare-earth magnet of 0.2 mm or less was obtained. Next, this magnetic powder was placed in a cavity of a die making up a carbide forming mold of 20×20×40 mm in size, which was sealed with carbide punches vertically. This was set in a chamber, and a pressure inside of the chamber was reduced to $10^{-2}$ Pa. Then load of 400 MPa was applied thereto while heating to 650° C. by a high-frequency coil for hot pressing. The state after this hot pressing was held for 60 seconds, and a compact (bulk) was taken out from the forming mold. Such a compact taken out was cut by wire-cutting into a test piece to be in size as illustrated in Table 1 to be a test piece for hot deformation processing. Next, each compact illustrated in Table 1 was set at a center position of the die of 15 mm illustrated in FIG. 8, to which hot deformation processing was performed under the conditions of the heating temperature at 750° C. (holding time 1 minute), the processing ratio of 75% (height 16 mm to 4 mm), the strain rate of 1/sec., and lubricant BN applied. Herein, BN spray was applied to the inner faces of the die before setting the compact in the die. Table 1 below also illustrates the results of a test piece as a reference example, using a metal capsule in the aforementioned conventional technique (metal capsule made of SS41 of 2 mm in thickness, having the width of 17.9 mm and the height of 16.5 mm on the outside and the width of 13.9 mm and the height of 12.5 mm on the inside).

TABLE 1

| | long-side length of compact (mm) | short-side length of compact t1(mm) | height of compact (mm) | short-side length of cavity W1(mm) | t1/W1 |
|---|---|---|---|---|---|
| Comp. Ex. 1-1 | 18 | 14.9 | 16 | 15 | 0.99 |
| Comp. Ex. 1-2 | | 13 | | | 0.87 |
| Ex. 1-1 | | 12.7 | | | 0.85 |
| Ex. 1-2 | | 12 | | | 0.80 |
| Ex. 1-3 | | 11 | | | 0.73 |
| Ex. 1-4 | | 10 | | | 0.67 |
| Ex. 1-5 | | 9 | | | 0.60 |
| Ex. 1-6 | | 8.25 | | | 0.55 |
| Comp. Ex. 1-3 | | 8 | | | 0.53 |
| Comp. Ex. 1-4 | 20 | 17.9 | 16 | 18 | 0.99 |
| Ex. 1-7 | | 16 | | | 0.89 |
| Ex. 1-8 | | 15.3 | | | 0.85 |
| Ex. 1-9 | | 14.5 | | | 0.81 |
| Ex. 1-10 | | 12 | | | 0.67 |
| Ex. 1-11 | | 11 | | | 0.61 |
| Ex. 1-12 | | 9.9 | | | 0.55 |
| Comp. Ex. 1-5 | | 9 | | | 0.50 |
| Ref. Ex. | 20 | 17.9 | 16 | 18 | 0.99 |

Figure 9:
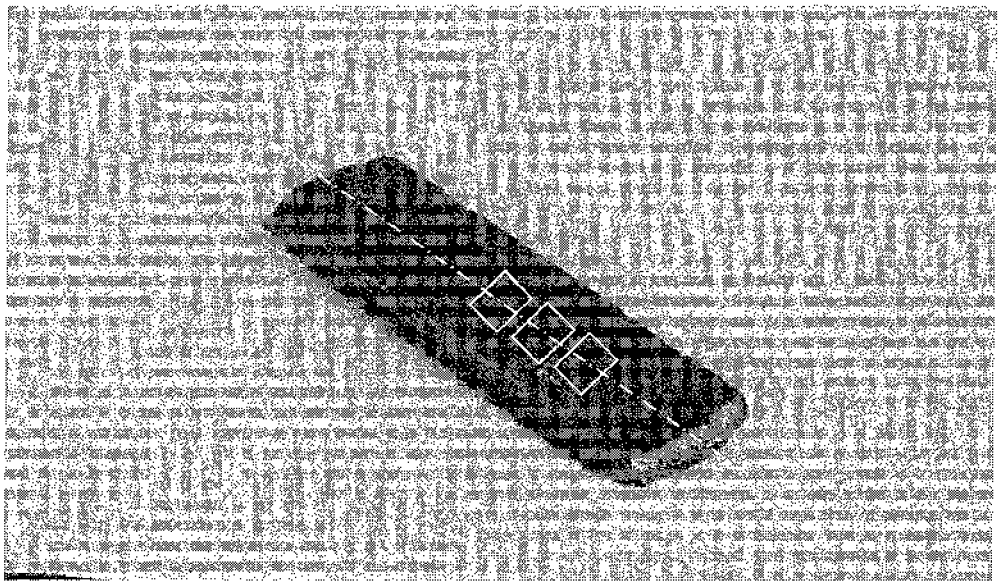
FIG. 9*a* describes an orientational magnet prepared for experiments and cut-out parts.
FIG. 9*b* is an enlarged view of FIG. 9*a*.
Figure 9:
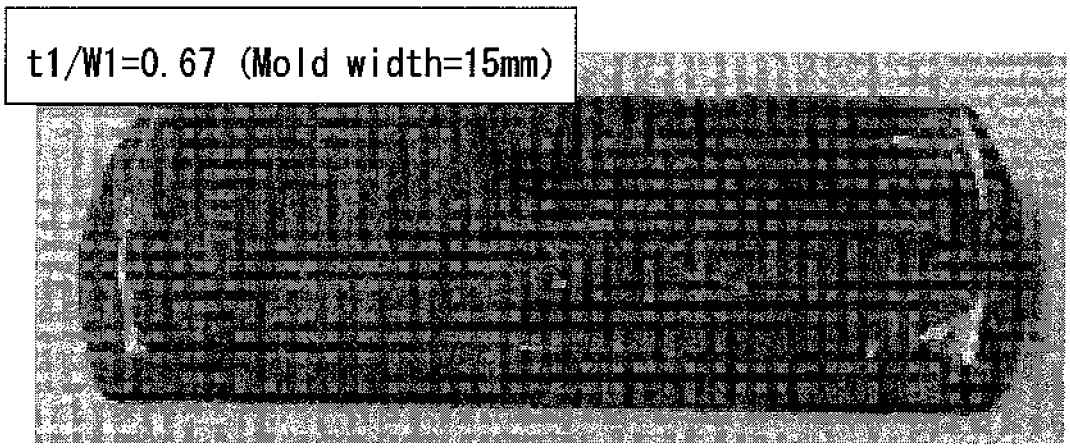

FIG. 9*a* illustrates an orientational magnet as a test piece after processing and its cut-out parts, and FIG. 9*b* is an enlarged view thereof. Note here that three parts (4×4×4 mm) surrounded with rectangles along the center line of FIG. 9*a* were cut out, whose magnetic properties were measured with a vibrating sample magnetometer (VSM).

Figure 10:
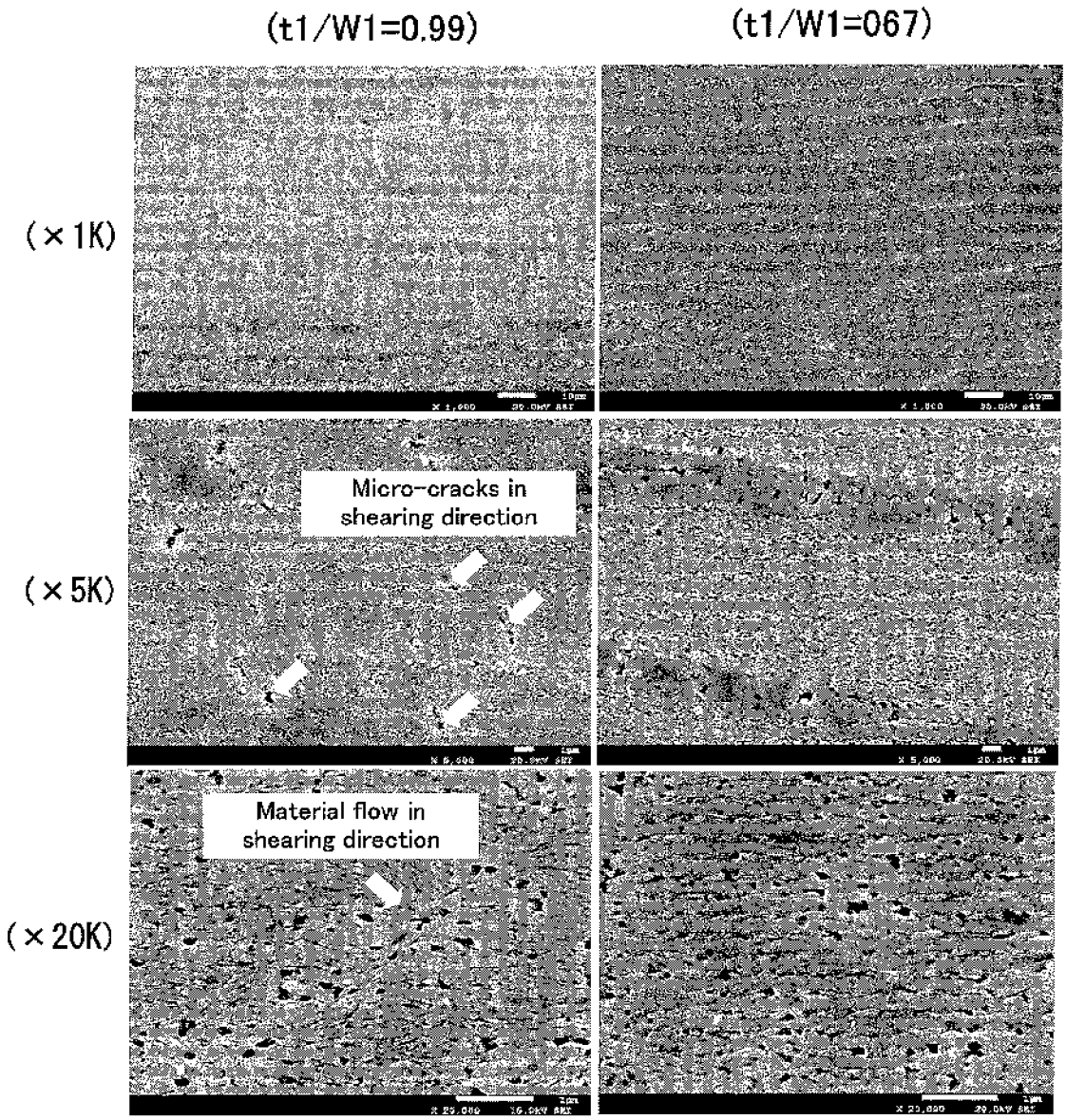
FIG. 10 are photographs of cross sections of the test pieces with t1/W1=0.99 and t1/W1=0.67 (orientational magnet of FIG. 9).
Figure 11:
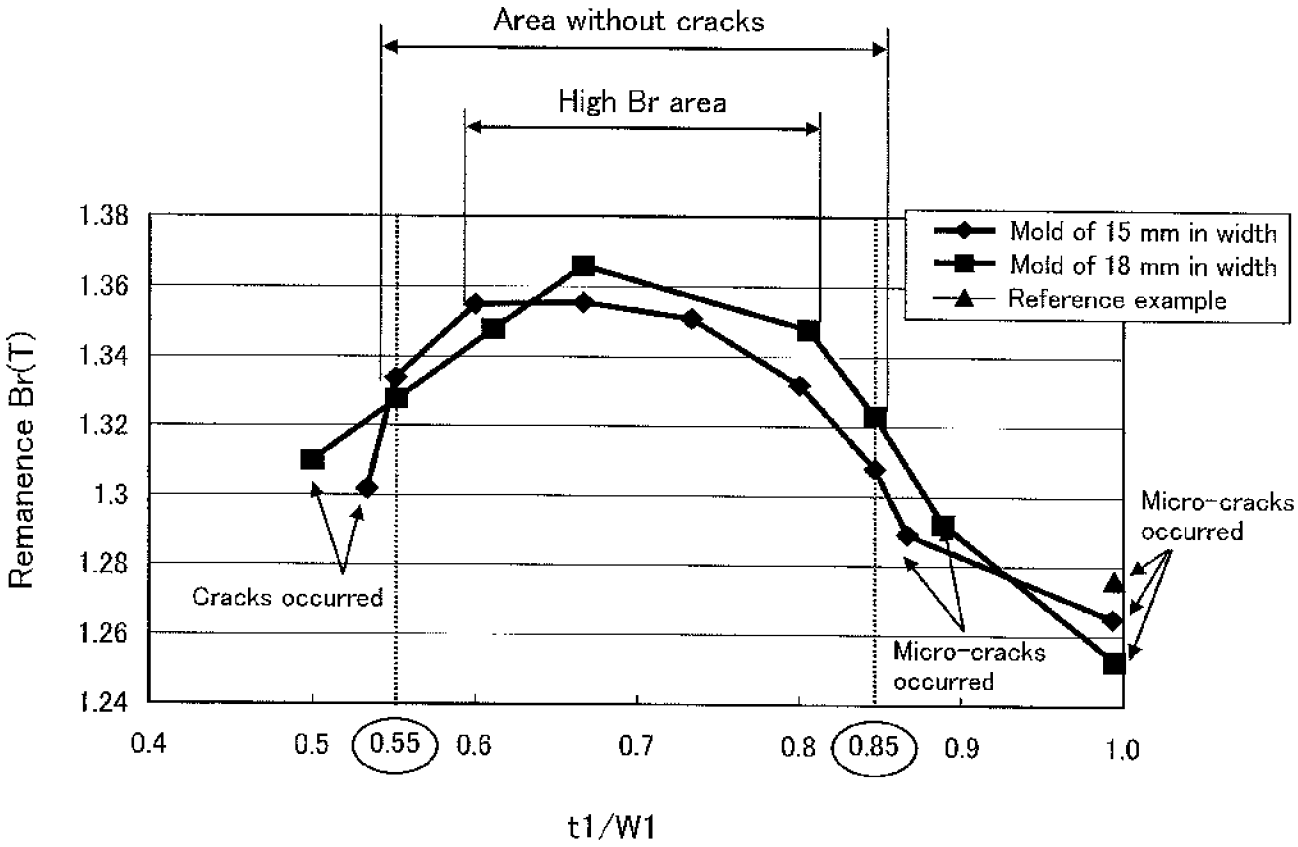
FIG. 11 illustrates the relationship between t1/W1 and remanence that was found from the experiment.

FIG. 10 illustrates photographs of the test piece of t1/W1=0.99 (comparative example) and the test piece of t1/W1=0.67 (embodiment) in cross section, and FIG. 11 shows the results of magnetic measurement of the test pieces.

FIG. 10 shows that the test piece of t1/W1=0.99 (≈1, comparative example) had micro-cracks in the shearing direction, and disturbance of orientation was observed because the plastic flow of crystals followed the cracks. It can be considered that such micro-cracks occurred because the long sides of the compact was strongly constrained by friction at the side faces of the cavity, and so the compact forcedly received inner stress with the progress of the deformation during the hot deformation processing (the amount of deformation of the compact that was constrained in deformation in the short-side direction was entirely pushed out in the long-side direction).

Meanwhile the test piece of t1/W1=0.53 (comparative example) generated noticeable cracks at the periphery, at which the processing strain was released, and additionally there was a wide place for escape during the processing at the periphery of the compact, meaning that back pressure that the crystals receives is not be very large, and so the deformation of crystals in the test piece also is not large. Considering this while referring to the mechanism to estimate the crystalline orientation illustrated in FIG. 5, whether the degree of orientation of crystals is high or not is interchangeable with how particles becoming flattened due to hot deformation processing are directed in their pressure-receiving direction.

Firstly it can be found from FIG. 11 that, when t1/W1 is in the range of 0.55 to 0.85, cracks including micro-cracks are not generated, and the residual flux density also shows very high values of 1.32 T or higher. It can be further found from this drawing that the range of t1/W1 that is 0.6 to 0.8 is preferable because the residual flux density shows still higher values of 1.35 T or more.

From these results, it is favorable to set the range of the ratio t1/W1 during hot deformation processing at the range of 0.55 to 0.85, where W1 denotes the short sides of the cavity that is a rectangle in cross section and t1 denotes the short sides of the compact to be placed therein, and the range of 0.6 to 0.8 is preferable. The reference example using a metal capsule also generated micro-cracks, and so unfavorable results were obtained therefrom.

Figure 12:
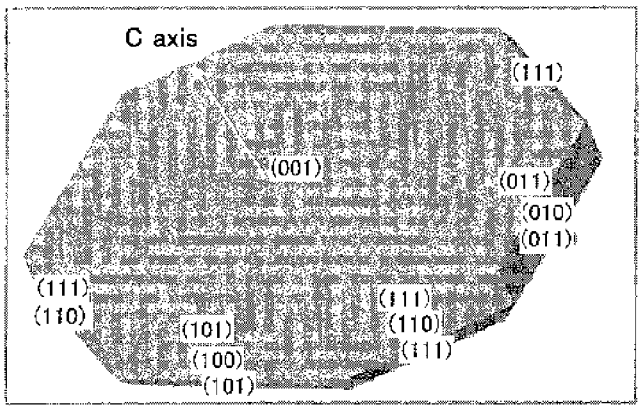
FIG. 12*a* illustrates the simulation of a crystalline shape, FIG. 12*b* describes the ratio of flatness of a crystal.
FIG. 12*c* illustrates the relationship between t1/W1 and the ratio of flatness that was found from the experiment.
Figure 12:
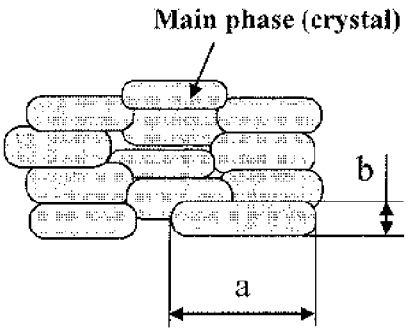
Figure 12:
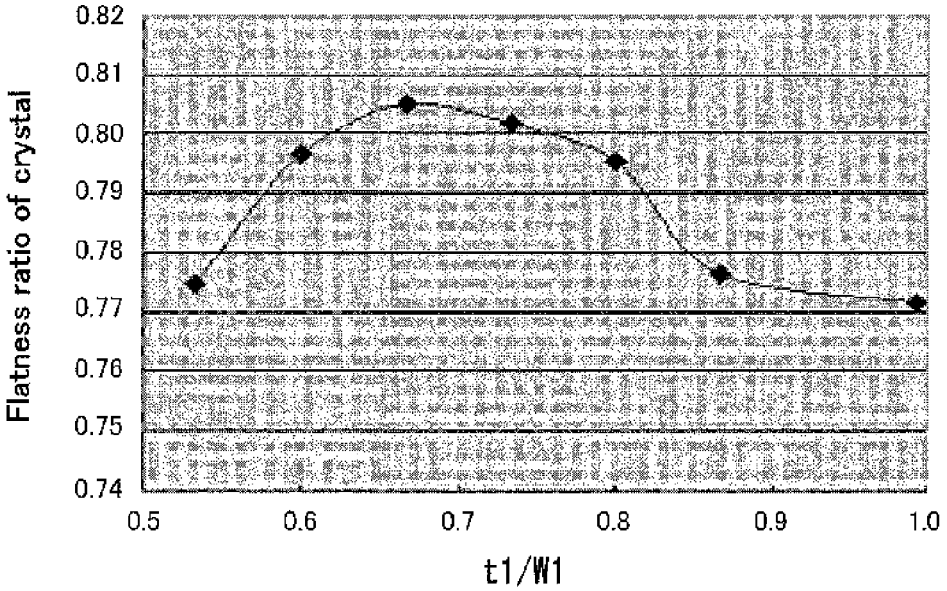

In FIG. 12*b*, the ratio of flatness can be calculated with (a−b)/a, and in this experiment, twenty crystals were selected at random from FE-SEM images of ×20,000, and their a and b were measured and averaged. Then, the relationship between the average and t1/W1 was found. FIG. 12*c* shows the result.

FIG. 12*c* shows that, when t1/W1 is in the range of 0.6 to 0.8, the ratio of flatness of the crystals shows a high value around 0.8, which corresponds to the result of the residual flux density in FIG. 11.

[Experiment to Find the Relationship Among RE Density of RE-Fe—B Main Phase (RE: Nd, Pr) in Orientational Magnet, Coercive Force and Remanence, and Result Thereof]

The present inventors conducted an experiment to examine the optimum amount of RE (RE: Nd, Pr) among magnetic powder components, using the test piece of t1/W1=0.67. Table 2 shows the materials used in this experiment.

TABLE 2

| | Total RE (Nd + Pr) (mass %) | Nd (mass %) | Pr (mass %) | B (mass %) | Co (mass %) | Ga (mass %) | Fe (mass %) |
|---|---|---|---|---|---|---|---|
| Comp. Ex. 2-1 | 27.8 | 27.3 | 0.5 | 0.91 | 4 | 0.4 | Bal. |
| Ex. 2-1 | 29.1 | 28.4 | 0.7 | 0.92 | 4 | 0.4 | Bal. |
| Ex. 2-2 | 30.4 | 30 | 0.4 | 0.93 | 4 | 0.4 | Bal. |
| Ex. 2-3 | 31.2 | 30.9 | 0.3 | 0.93 | 4 | 0.4 | Bal. |
| Comp. Ex. 2-2 | 32.4 | 31.8 | 0.4 | 0.93 | 4 | 0.4 | Bal. |

Figure 13:
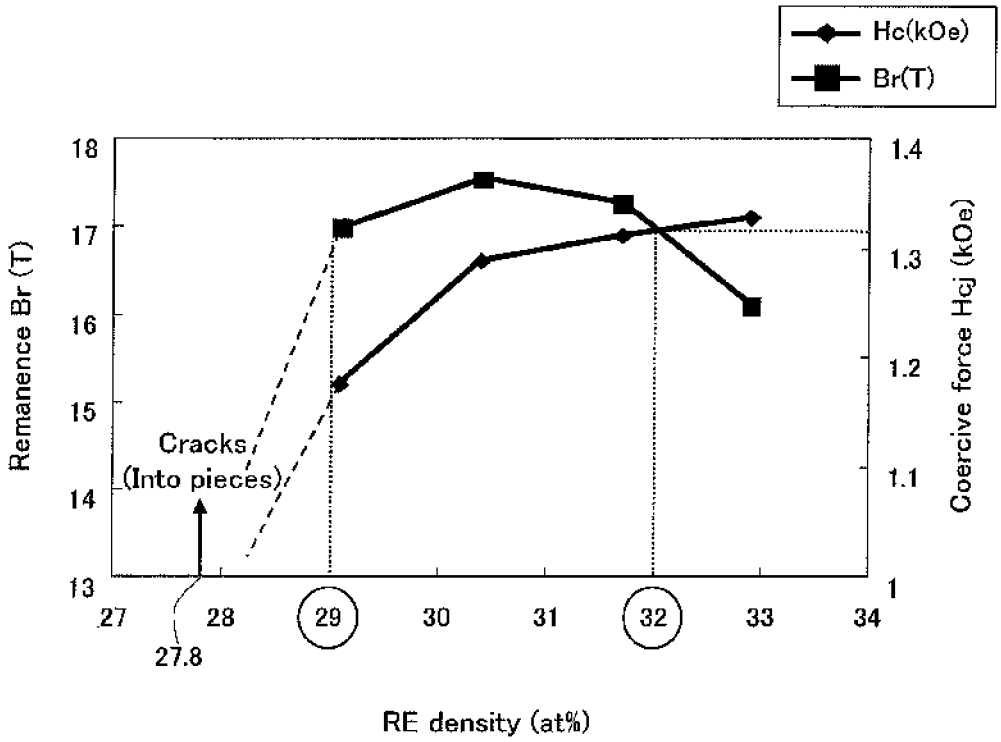
FIG. 13 illustrates the relationship among RE density of RE-Fe—B main phase (RE: Nd, Pr) of the orientational magnets, the coercive force and the remanence that was found from the experiment.

A compact was manufactured using the magnetic powder of the components shown in Table 2 and in a similar manner to the experiment to find the optimum range of t1/W1 (20×12×16 mm, the width was 12 mm), and hot deformation processing was performed using a plastic processing mold having a short side of 18 mm in length. The conditions for the hot deformation processing also were similar to those of the experiment to find the optimum range of t1/W1. FIG. 13 shows the result of the experiment.

As shown in the drawing, when the density of RE (Nd+Pr) falls below 29%, the grain boundary phase with excellent flattening property becomes less, causing cracks greatly occurring during hot deformation processing and so leading to the difficulty in obtaining a test piece for magnetic measurement. Additionally, such cracks occurred before the completion of orientation, lower degree of orientation (≈Br) is expected. Further, due to less grain boundary phase, magnetic separation property deteriorates, and the coercive force also is not high.

On the other hand, when the RE density increases (32.4% in comparative example), then Br decreases, and so the degree of orientation decreases more than a decrease in the ratio of main phase. This is because increased grain boundary phase absorbs more amount of strain there, and so the ratio of deformation and rotation of crystals decreases.

The result of this experiment shows that the density of RE (Nd+Pr) in the main phase (crystals) of the orientational magnet (rare-earth magnet) manufactured is desirably in the range of 29 mass % or more and 32 mass % or less.

[Experiment Relating to the Size of Crystal, the Presence or not of Cracks at Orientational Magnet and Magnetic Characteristics and Result Thereof]

The present inventors further prepared magnets shown in Table 3 below to find the influences of the size of crystals using the test piece of t1/W1=0.67, and hot deformation processing was performed under the processing conditions shown in Table 4. Table 5 below shows the result of observation relating to the presence or not cracks, and then magnetic characteristics were measured for magnets free from cracks. Table 6 below shows the result.

TABLE 3

| | magnet types | average crystal grain size (μm) |
|---|---|---|
| Ref. Ex. | molded magnet using metal capsule | 20 |
| A | molded magnet | 20 |
| B | sintered magnet | 4.5 |
| C | HDDR | 0.6 |
| D | melt-spun magnet 1 | 0.5 |
| E | melt-spun magnet 2 | 0.3 |
| F | melt-spun magnet 3 | 0.1 |

The capsule of the reference example had the same specifications as those for the experiment to find the optimum range of t1/W1.

TABLE 4

| processing ratio (%) | 75 | | | |
|---|---|---|---|---|
| processing temp. (° C.) | 750 | | 850 | |
| strain rate (/sec) | 0.01 | 0.1 | 1 | 3 |

TABLE 5

(○: no cracks, x: cracks occurred)

| | processing ratio (%) 75 | | | | | | | |
|---|---|---|---|---|---|---|---|---|
| | processing temp. (° C.) | | | | | | | |
| | 750 | | | | 850 | | | |
| strain rate (/sec) | 0.01 | 0.1 | 1 | 3 | 0.01 | 0.1 | 1 | 3 |
| Ref. Ex. | x | x | x | x | x | x | x | x |
| A | x | x | x | x | x | x | x | x |
| B | x | x | x | x | x | x | x | x |
| C | x | x | x | x | x | x | x | x |
| D | x | x | x | x | ○ | x | x | x |
| E | ○ | ○ | ○ | x | ○ | ○ | ○ | ○ |
| F | ○ | ○ | ○ | ○ | ○ | ○ | ○ | ○ |

TABLE 6

| | | processing ratio (%) 75 | | | | | | | |
|---|---|---|---|---|---|---|---|---|---|
| | | processing temp. (° C.) | | | | | | | |
| | | 750 | | | | 850 | | | |
| | strain rate (/sec) | 0.01 | 0.1 | 1 | 3 | 0.01 | 0.1 | 1 | 3 |
| coercive force (kOe) | D | x | x | x | x | 9.2 | x | x | x |
| | E | 11.2 | 13.7 | ***14.8*** | x | 10.9 | 11.2 | 12.8 | 13.7 |
| | F | 12.4 | ***14.2*** | ***15.4*** | ***16.1*** | 12.3 | 12.1 | 13.4 | ***14.6*** |
| remanence (T) | D | x | x | x | x | 1.16 | x | x | x |
| | E | 1.24 | 1.29 | ***1.33*** | x | 1.21 | 1.2 | 1.23 | 1.23 |
| | F | ***1.41*** | ***1.37*** | ***1.36*** | ***1.36*** | ***1.35*** | ***1.33*** | ***1.3*** | 1.29 |

Note:
Bold Italics represent favorable results.

It was found from Table 5 that cracks cannot be suppressed for a magnet including large crystals in size when the components and the rate of strain of the present embodiment were used, and that cracks cannot be suppressed with the rate of strain (0.1/sec) or more to obtain a higher coercive force unless the size is 300 nm or less in average. It can be considered that large crystalline grains lead to difficulty in rotation during the processing or difficulty in arrangement by recrystallization.

Table 6, which shows the result of magnetic characteristics of the test pieces that did not generate cracks in Table 5, shows that the test pieces having the average grain size of 300 nm or lower and the rate of strain of 0.1/sec. or more had effective characteristics. That is, according to the manufacturing method of the present invention, magnetic powder having a RE-Fe—B main phase of small crystalline grains is used, and appropriate constraint and appropriate degree of freedom are given by a plastic processing mold during the hot deformation processing, whereby a rare-earth magnet having excellent magnetic characteristics, which results from no cracks and the optimum controlled material flow, can be obtained in the form of a net shape.

Although the embodiments of the present invention have been described in details with reference to the drawings, the specific configuration is not limited to these embodiments, and the design may be modified without departing from the subject matter of the present invention, which falls within the present invention.

REFERENCE SIGNS LIST

R Copper roll
B Melt-spun ribbon (rapidly quenched ribbon)
D, D1, D2, D' Carbide die
P, P' Carbide punch
Ca, Ca1, Ca2 Cavity
G Gap
t1 Length of short sides of compact
W1 Length of short sides of cavity
S Compact
C Orientational magnet (rare-earth magnet)
C' Intermediary body of orientational magnet
MP Main phase (nano-crystalline grains, crystalline grains, crystals)
BP Grain boundary phase

The invention claimed is:

1. A method for manufacturing a rare-earth magnet, comprising:

a first step of press-forming powder as a rare-earth magnetic material to form a columnar compact;

preparing a plastic processing mold including a die in which a cavity is provided to place the compact therein, and punches that are slidable in the cavity, the cavity having a cross section that is larger in cross-sectional dimensions than a cross section of the compact that is orthogonal to a pressing direction by the punches; and a second step of placing the compact in the cavity and sandwiching the compact with the punches vertically, and performing hot deformation processing to give magnetic anisotropy to the compact while directly pressing an upper face and a lower face of the compact with the punches vertically, thus manufacturing the rare-earth magnet that is an orientational magnet, wherein let that W1 denotes a length of a short side of the cross section of the cavity and t1 denotes a length of a side of the cross section of the compact that is placed in the cavity, the side corresponding to the short side of the cavity, t1/W1 is within a range of 0.55 to 0.85, and from some stage during the hot deformation processing at the second step, a part of the compact is constrained at a side face of the cavity so that deformation of the compact is suppressed, but another part of the compact is away from a side face of the cavity to be in a non-constraint state.

2. The method for manufacturing a rare-earth magnet according to claim 1, wherein the cavity is a rectangle in the cross section, including a short side of W1 in length and a long side of W2 in length, the compact is a rectangle having a short side of t1 in length in the cross section, or is a square having a side of t1 in length in the cross section, and at some stage during the hot deformation processing at the second step, a pair of opposed sides of the rectangle or the square in the cross section of the compact comes into contact with two of the opposed long sides of the cavity, and when the compact is further pressed, the other pair of opposed sides in the cross section of the compact is away from the short sides of the cavity to be in a non-constraint state.

3. The method for manufacturing a rare-earth magnet according to claim 2, wherein in the second step, two plastic processing molds are prepared, including two dies that are different in cross-sectional dimensions of cavities and punches having cross-sections in accordance with the cross-sectional dimensions of the dies, and hot deformation processing is performed to the compact using the plastic processing mold including the cavity that has relatively small dimensions in cross section so that a pair of opposed sides of the rectangle or the square in the cross section of the compact comes into contact with two of the opposed long sides of the cavity to prepare an intermediary body of the orientational magnet, and then the intermediary body is placed in the plastic processing molding including the cavity that has relatively large dimensions in cross section and hot deformation processing is performed to the intermediary body so that a pair of opposed sides of a rectangle or a square in cross section of the intermediary body comes into contact with two of the opposed long sides of the cavity to manufacture the rare-earth magnet that is an orientational magnet.

4. The method for manufacturing a rare-earth magnet according to claim 1, wherein during the hot deformation processing, a rate of strain is 0.1/sec. or more.

5. The method for manufacturing a rare-earth magnet according to claim 1, wherein the powder as the rare-earth magnetic material includes a RE-Fe—B main phase (RE: at least one type of Nd and Pr) and a RE-X alloy (X: metal element) grain boundary phase surrounding the main phase, the powder being prepared by grinding a melt-spun ribbon, the content of RE being 29 mass %≤RE≤32 mass %, and the main phase of the rare-earth magnet manufactured having an average grain size of 300 nm or less.

* * * * *